US005803256A

United States Patent [19]

Lydhig et al.

[11] Patent Number: 5,803,256

[45] Date of Patent: Sep. 8, 1998

[54] METHOD FOR PROVIDING BAG-LIKE PACKAGES OF DISPOSABLE ABSORBENT ARTICLES WITH BAGS FOR THE TEMPORARY KEEPING OF USED ARTICLES

[75] Inventors: Thomas Lydhig, Göteborg; Arne Fröidh, Stenungsund, both of Sweden

[73] Assignee: Molnlycke AB, Gothenburg, Sweden

[21] Appl. No.: 817,637

[22] PCT Filed: Oct. 26, 1995

[86] PCT No.: PCT/SE95/01272

§ 371 Date: Apr. 21, 1997

§ 102(e) Date: Apr. 21, 1997

[87] PCT Pub. No.: WO96/13446

PCT Pub. Date: May 9, 1996

[30] Foreign Application Priority Data

Oct. 27, 1994 [SE] Sweden ..... 9403690

[51] Int. Cl.[6] ..... A61B 00/00; B65B 43/04; B65D 30/22

[52] U.S. Cl. ..... 206/440; 53/455; 206/554; 383/40

[58] Field of Search ..... 206/438, 440, 206/494, 554; 383/38, 40; 53/455, 459, 469

[56] References Cited

U.S. PATENT DOCUMENTS

| | | | |
|---|---|---|---|
| 2,478,412 | 8/1949 | McMahan | 206/440 X |
| 2,750,033 | 6/1956 | Pickens | 206/440 X |
| 3,148,771 | 9/1964 | Miller, Jr. | 206/440 |
| 3,797,734 | 3/1974 | Flevny et al. | 393/40 X |
| 4,735,316 | 4/1988 | Fröidh et al. | 206/438 |
| 4,743,240 | 5/1988 | Powell . | |
| 4,883,675 | 11/1989 | Wernz . | |

FOREIGN PATENT DOCUMENTS

| | | | |
|---|---|---|---|
| 0 258 143 | 3/1988 | European Pat. Off. . | |
| 0 420 463 | 4/1991 | European Pat. Off. . | |
| 2 603 024 | 4/1986 | France . | |
| 0294448 | 11/1989 | Japan | 383/40 |
| 92 01624 | 11/1993 | Sweden . | |
| WO 89/02398 | 3/1989 | WIPO . | |

*Primary Examiner*—Bryon P. Gehman
*Attorney, Agent, or Firm*—Young & Thompson

[57] ABSTRACT

A method for providing bag-like packaging units (4) for receiving absorbent disposable articles, such as incontinence guards, sanitary napkins and diapers, with bags (5) in which used articles can be kept temporarily. According to the invention, the packaging unit is provided with a pocket (7, 9) into which the bags (5) are inserted prior to filling the packaging unit with absorbent particles. The present invention also relates to a packaging unit with which the method can be carried out.

10 Claims, 2 Drawing Sheets

METHOD FOR PROVIDING BAG-LIKE PACKAGES OF DISPOSABLE ABSORBENT ARTICLES WITH BAGS FOR THE TEMPORARY KEEPING OF USED ARTICLES

FIELD OF THE INVENTION

The present invention relates to a method for providing bag-like packages of disposable absorbent articles, such as incontinence guards, sanitary napkins and diapers, with bags in which used articles can be kept temporarily. The invention also relates to a packaging unit for use when carrying out the method.

BACKGROUND OF THE INVENTION

In the case of known packaging units of this kind, the bags intended for used articles are inserted in a so-called envelope which is inserted in the packaging unit at the same time as the articles are inserted. This complicates article packaging procedures and will often result in breakdowns in operation. Furthermore, it is necessary to adapt the packaging equipment so as to enable the envelope to be inserted, which complicates the equipment and leads to higher costs.

SUMMARY OF THE INVENTION

Accordingly, an object of the present invention is to avoid the aforesaid drawbacks and to provide an operationally reliable method of providing packaging units for disposable absorbent articles with bags in which used articles can be kept temporarily.

This object is achieved in accordance with the invention by means of a method according to the aforesaid kind which is characterized by providing the packaging unit with a pocket, and by inserting the bags into the pocket prior to filling the packaging unit with articles. Both of these processes can be optimized, by separating the bag insertion process from the article insertion process, therewith resulting in fewer breakdowns in operation in total, at the same time as the separate processes are less complicated, and therewith also more cost-effective than the known method, in which the bags are inserted into the packaging unit at the same time as the articles are inserted.

According to one preferred embodiment, the pocket is given generally the same dimensions as the dimensions of one side of the packaging unit. This facilitates insertion of articles into a packaging unit in which bags have already been inserted.

According to another embodiment, according to which the packaging unit is opened prior to inserting the articles by lifting one side of the packaging unit in relation to its opposing side, the pocket is placed on that side of the packaging unit which is lifted for insertion of articles into the packaging unit, or on the side that lies opposite to this side.

The bags may also be inserted into the packaging unit in conjunction with its manufacture.

The present invention also relates to a bag-like packaging unit for the packaging of disposable absorbent articles, such as incontinence guards, sanitary napkins and diapers, said unit including two large mutually opposing sides which are inter-joined by two mutually opposing short sides and a bottom, characterized in that one of the two large sides includes a pocket which extends from the bottom towards the opening of the packaging unit over at least half the length of said large side and into which there is inserted a given number of bags intended for the temporary keeping of used articles. A packaging unit of this design facilitates the insertion of articles and bags into the unit.

According to one preferred embodiment of the inventive packaging unit, the pocket extends over essentially the whole of said large side and is placed on the inside of said large side of the packaging unit. An information folder or the like is also inserted in the pocket.

BRIEF DESCRIPTION OF THE DRAWINGS

The invention will now be described in more detail with reference accompanying drawings, in which.

DETAILED DESCRIPTION OF THE INVENTION

Figure 1:
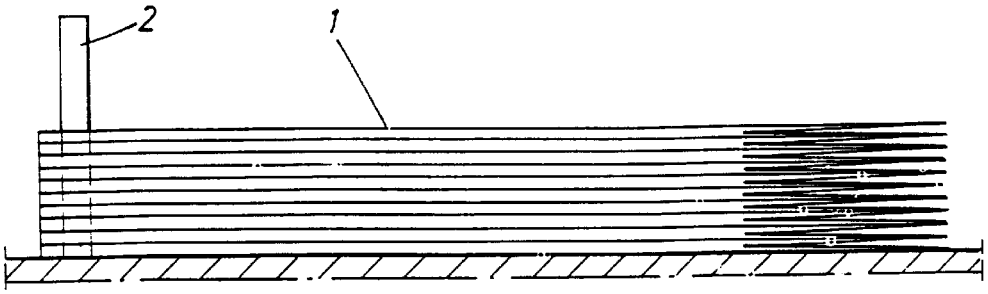
FIG. 1 is a schematic side view of part of a bag-filling apparatus to which empty bag-like packaging units are delivered.

FIG. 1 illustrates schematically and in side view part of a packaging unit filling apparatus to which empty bag-like packaging units 1 are delivered, said units being threaded onto two upstanding pins 2 on the filling apparatus, of which only one pin is shown in the Figure. The bag-like packaging units are filled by lifting the upper side of a packaging unit 1, as seen in the Figure, with the aid of a suction cup or some like device for instance, whereafter the articles to be inserted into the packaging unit are brought, in some suitable manner, to a position opposite the packaging opening formed by lifting said upper side of the packaging unit, and then inserted into said unit. The filled packaging unit, i.e. the package, is released from the pins 2 and moved to one side, and the upper side of the previously underlying packaging unit is lifted and the next stack of articles is inserted into the unit. The packaging units located on the pins 2 are thus filled one after the other. This method of filling packaging units has been well tested and has proven to be reliable in practice.

In known methods of introducing into the packaging unit bags that are intended for keeping used articles temporarily, an envelope which contains a given number of such bags is inserted into the packaging unit at the same time as the articles are inserted. This method greatly complicates the filling process, because the envelopes must be delivered to the stack of articles to be inserted into the packaging unit and retained relative to said stack during the initial part of the packaging procedure. The process is further complicated because, for space reasons, absorbent sanitary articles are often packed while in a compressed state, which places relatively high demands on the precision of the equipment used to guide the article stack and the bag-containing envelope during the initial stage of inserting the stack and the envelope into the packaging unit. There is thus a need of simplifying the known method in which packaging units of this kind are provided with such bags.

Figure 2:
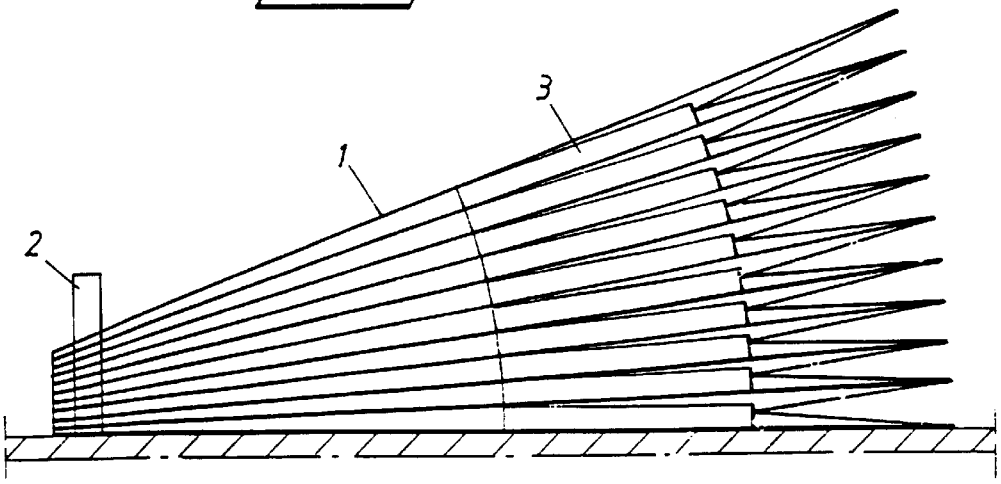
FIG. 2 is a view similar to FIG. 1, wherein a bag-containing envelope inserted into the packaging units.

FIG. 2 illustrates the configuration of the packaging units 1 threaded on the pins 2, wherein the known envelope 3 containing a specific number of bags has been inserted earlier into the packaging units. It will be seen that the conventional method of inserting articles into the packaging units 1 cannot be applied readily in the case of such packaging procedures.

Figure 3:
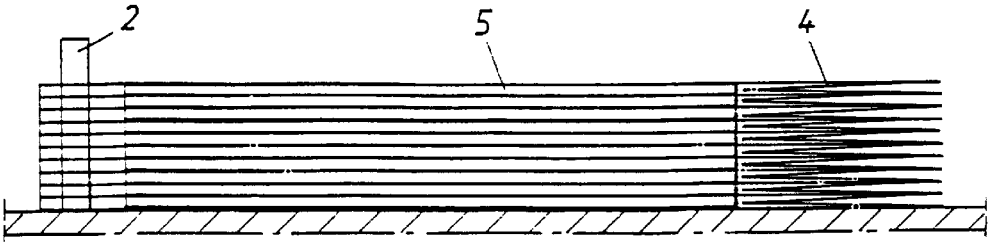
FIG. 3 a view similar to FIG. 1, in which packaging units constructed in accordance with one embodiment of the invention are delivered to said apparatus.

FIG. 3 illustrates packaging units 4 constructed in accordance with one embodiment of the invention and threaded on the pins 2 of the filling apparatus, said packaging units containing a specific number of bags in a bundle 5. As will be seen from the Figure, the bundle 5 has a large extension in a direction corresponding to the direction in which the articles are inserted, i.e. from the left to the right in FIG. 3. The top and bottom sides of the packaging units 4 in the stack of units fitted on the pins 2 will thereby extend parallel with the article insertion direction, which is important with regard to disturbance-free operation of the filling apparatus. The outward extension of the bundle 5 as seen in the insertion direction will therefore preferably at least exceed half the extension of the packaging unit in said direction. The bundle 5 will preferably have essentially the same dimensions as the top and bottom sides of the packaging unit 4.

Figure 4:
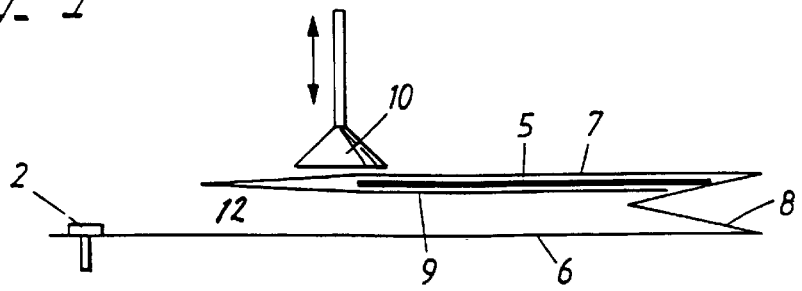
FIG. 4 illustrates schematically a filling apparatus to which a packaging unit constructed in accordance with one embodiment of the invention is delivered.

A preferred embodiment of the packaging unit 4 is shown schematically in FIG. 4. As will be seen from this Figure, the packaging unit 4 includes two mutually opposing large sides, a bottom side 6 and a top side 7, which are mutually connected by a bottom 8 and two mutually opposing short sides (not shown in the Figure). The packaging unit also includes a sheet 9 which has generally the same dimensions as the top side 7 and which is placed beneath said top side and fastened thereto along its side edges and at an end edge which is distal from the bottom 8. A bundle 5 of bags is placed in the pocket thus formed.

It is pointed out in this regard that the above defined sides of the packaging unit are not always found in the case of an empty, flat packaging unit, for instance when the packaging unit is formed from plastic sheets which are placed one upon the other in a flat state and joined together along opposing long edges and one transverse edge. Consequently, the dimensions recited in respect of the sides of the packaging unit relate to the configuration of a filled packaging unit.

Figure 5:
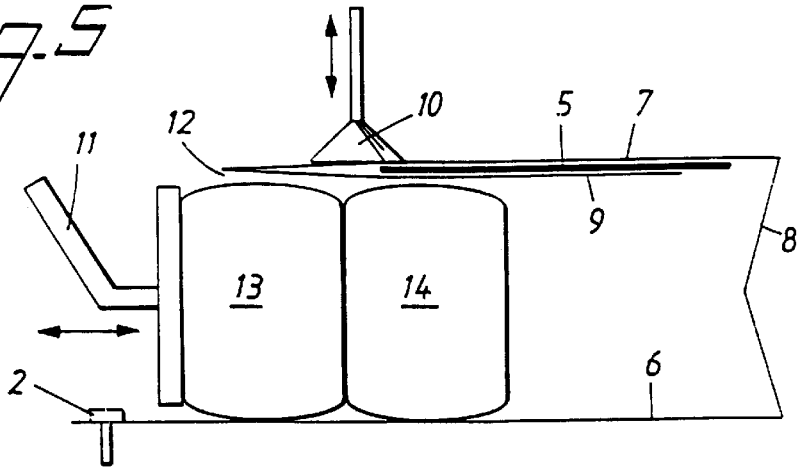
FIG. 5 and FIG. 6 illustrate schematically the insertion of disposable absorbent articles into one such packaging unit.
Figure 6:
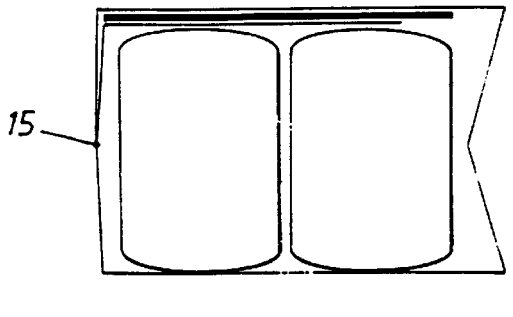

FIG. 4 also illustrates schematically a pin 2, a suction cup 10 and an infeeder 11 included in the filling apparatus. When inserting absorbent articles into the packaging unit 4, the suction cup 10 lifts the upper part of the packaging unit to the position shown in FIG. 4, therewith forming an opening 12, said upper part including the sheet 9, the bundle 5 and the top side 7 of the unit. At the same time, the infeeder 11 is withdrawn to the left in FIGS. 4–6, so as to provide room for two stacks 13, 14 of articles which are to be inserted into the packaging unit 4. After having brought the article stacks 13, 14 in front of the opening 12 in some suitable manner, the infeeder 11 is moved from left to right in the Figure so as to push the article stacks into the packaging unit, as illustrated in FIGS. 5 and 6. Those parts of the top and bottom sides of the packaging unit which project outwardly of the inserted stacks 13, 14 are then folded in against one another and joined together in some suitable manner, for instance by means of a weld join 15. The packaging unit, or rather the package, will then have the configuration shown in FIG. 6.

According to one variant of the described method, the empty packaging units are placed in a box or like receptacle, from which they are lifted and placed onto a vacuum transporter which transports single empty packaging units to a filling station, in which the empty packaging units are filled with articles and sealed in the aforedescribed manner.

Figure 7:
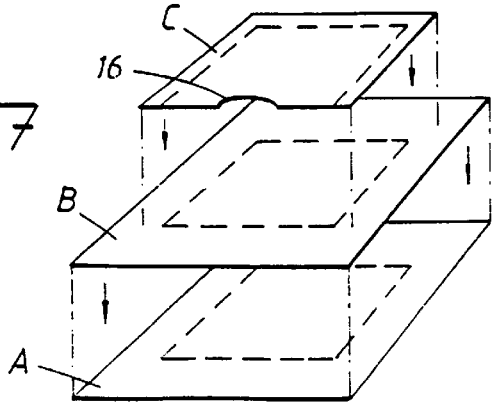
FIG. 7 illustrates schematically a step in the manufacture of a packaging unit constructed in accordance with one embodiment of the invention.

FIG. 7 illustrates schematically a packaging unit constructed in accordance with one embodiment of the invention and shows said unit in a stage of manufacture. The Figure shows three plastic sheets A, B and C which are brought together, as indicated by the arrows, and mutually joined at their edge parts. In this way, there is formed a bag-like packaging unit which includes an upper pocket for receiving a bundle of bags. A bag bundle is placed in the formed pocket in a following stage of manufacture. According to one preferred variant, a folder or like device carrying information is placed in the pocket together with the bags. The folder is conveniently made of a stiffer material than the plastic material from which the bags are preferably made, thereby facilitating insertion of the bundle of bags. The part C is provided with a recess 16, with the intention of facilitating removal of bags from the packaging unit. The dimensions of the top and bottom sides of a filled packaging unit, or package, are indicated in broken lines in the Figure.

The invention thus provides a method in which the bags are inserted into the packaging unit prior to inserting articles thereinto. This enables existing packaging equipment to be used to introduce articles into the packaging unit without requiring the equipment to be modified, which is advantageous from the aspects of operational reliability and cost. Because the packaging unit includes a separate bag receiving space in the form of said pocket, the prior insertion of the bags will not disturb the subsequent insertion of the articles. Furthermore, the inventive packaging unit enables the filling apparatus to be simplified, because the pocket is given essentially the same transverse dimensions as that side of the packaging unit which is lifted to form the unit-filling opening, and because the bag bundle inserted into the pocket can be imparted such rigidity, for instance with the aid of an information folder, that when exerting a lifting force on one point of the pocket the entire transverse-edge part of the pocket will be lifter and therewith the whole of the upper large side of the packaging unit.

It will be understood that the described and illustrated exemplifying embodiments of the invention can be modified in many ways within the scope of the invention. For instance, the package can be constructed by placing bundles of bags intermittently on a first moving web of plastic material, and then placing on the first web a second web of plastic material whose width while being smaller than the width of the first web is slightly greater than the width of a bag bundle, and then fastening the second web to the first web along their longitudinal edges. The composite web formed by the two first and second webs and the row of intermediate bag bundles is then placed on a third web of plastic material whose width is the same as the width of the first web, and the long edges of the first and the third web are then joined together. Finally the three webs are joined together by means of joining lines which extend transversely between adjacent bag bundles, whereafter the packages constructed in accordance with the invention are cut from the continuous three-layer web by transverse cuts in the proximity of the transverse joining lines. The inventive packaging unit can also be produced by placing a bag bundle on an elongated piece of plastic and placing a plastic sheet on top of the bag bundle and fastening the plastic sheet to said piece of plastic along three edges, and thereafter folding the elongated piece of plastic beneath the bag bundle in a single fold, such that its long edges will coincide, whereafter the long edges are joined together. The inventive packages may also be provided conveniently with appropriate tear lines, to facilitate opening of a closed package. The pocket formed in the packaging unit may also be provided with tear lines of this kind, particularly when the pocket is closed in conjunction with manufacturing the packaging unit or package. Such tear lines will preferably be provided in the bottom of the packaging unit to be filled, and the inwardly folded part of the top and bottom sides of the packaging unit shown in FIG. 6 thus form the bottom part of a closed packaging unit, or package, whereas the illustrated bottom 8 forms the openable top part of a filled packaging unit. In the case of the embodiment illustrated in FIGS. 4–6, the pocket is provided within the actual packaging space of the packaging unit, although it will be understood that the pocket may be provided on the outside of the packaging unit instead. Furthermore, the pocket may be joined to the bottom large side of the packaging unit instead of to the other large side thereof, which is the case in the illustrated embodiment.

It will therefore also be understood that the invention is restricted solely by the contents of the following claims.

We claim:

1. A method for providing a packaging unit containing absorbent disposable articles selected from the group consisting of incontinence guards, sanitary napkins and diapers, and also bags in which used articles can be kept temporarily, the packaging unit including an infeed opening, a first large side and a mutually opposing second large side, which are joined together by two mutually opposing short sides, and a bottom, the method comprising: providing the first large side of the unit with a pocket which extends from the infeed opening towards the bottom, the end of the pocket turned against the bottom being open, and giving the pocket as seen in the direction for insertion of the articles a length which at least exceeds half the length of the first large side, inserting the bags into said pocket, and thereafter introducing said articles into the unit.

2. A method according to claim 1, further comprising giving the pocket substantially the same dimensions as one side of the packaging unit.

3. A method according to claim 1, further comprising opening the unit prior to inserting the articles into said unit, by lifting one side of the unit in relation to the opposing side thereof, and placing the pocket on that side of the packaging unit which is lifted when inserting articles into said, unit.

4. A method according to claim 1, further comprising opening the unit prior to inserting the articles into the packaging unit, by lifting one side of said unit in relation to the opposing side thereof, and placing the pocket on that side of the packaging unit which lies opposite to the side that is lifted when inserting articles into said unit.

5. A method according to claim 1, wherein the bags are inserted into the packaging unit in conjunction with the manufacture of said unit.

6. A packaging unit for disposable absorbent articles selected from the group consisting of incontinence guards, sanitary napkins and diapers, the packaging unit comprising: an infeed opening, a first large side and a mutually opposing second large side which are joined together by two mutually opposing short sides and a bottom, wherein the first large side is provided with a pocket which extends from the infeed opening towards the bottom of the packaging unit at least along half the length of the first large side, the end of the pocket turned against the bottom being open, and wherein the pocket contains a specific number of bags in which used articles can be kept temporarily.

7. A packaging unit according to claim 6, wherein the pocket has generally the same dimensions as the first large side of the packaging unit.

8. A packaging unit according to claim 6, wherein the pocket is placed on the inside of one of the large sides of the packaging unit.

9. A packaging unit according to claim 6, wherein the pocket is placed on the outside of one of the large sides of the packaging unit.

10. A packaging unit according to claim 6, further comprising an information folder inserted in the pocket.

* * * * *